US007929381B2

(12) United States Patent
Abe

(10) Patent No.: US 7,929,381 B2
(45) Date of Patent: Apr. 19, 2011

(54) TIME INFORMATION OBTAINING APPARATUS AND RADIO TIMEPIECE

(75) Inventor: Hideo Abe, Tokorozawa (JP)

(73) Assignee: Casio Computer Co., Ltd., Tokyo (JP)

( * ) Notice: Subject to any disclaimer, the term of this patent is extended or adjusted under 35 U.S.C. 154(b) by 94 days.

(21) Appl. No.: 12/498,609

(22) Filed: Jul. 7, 2009

(65) Prior Publication Data

US 2010/0008192 A1 Jan. 14, 2010

(30) Foreign Application Priority Data

Jul. 9, 2008 (JP) ..... 2008-178751

(51) Int. Cl.
*G04C 11/02* (2006.01)

(52) U.S. Cl. ..... 368/47; 368/46

(58) Field of Classification Search ..... 368/46, 368/47

See application file for complete search history.

(56) References Cited

U.S. PATENT DOCUMENTS

| | | | | |
|---|---|---|---|---|
| 2003/0117901 | A1* | 6/2003 | Takada et al. | 368/47 |
| 2005/0094495 | A1* | 5/2005 | Takada et al. | 368/47 |
| 2005/0195690 | A1 | 9/2005 | Kondo | |
| 2006/0067166 | A1* | 3/2006 | Murata et al. | 368/47 |
| 2008/0239879 | A1 | 10/2008 | Someya | |

FOREIGN PATENT DOCUMENTS

JP 2005-249632 A 9/2005

* cited by examiner

*Primary Examiner* — Renee Luebke
*Assistant Examiner* — Jason Collins
(74) *Attorney, Agent, or Firm* — Holtz, Holtz, Goodman & Chick, PC

(57) ABSTRACT

A signal composing circuit 12 receives a signal including a time code from a receiving circuit 10, and detects input waveform data of a unit time length, whose value at ach sampling point is given by a value expressed in plural bits. The input waveform data is accumulated. CPU 13 calculates a minimum position on a time axis, where the minimum value of the accumulated input waveform data is given and a maximum gradient position on the time axis, where a difference between values of the accumulated input waveform data at adjacent sampling points is maximum, and further calculates a leading position of a unit time length of the signal including the time code.

7 Claims, 10 Drawing Sheets

TIME INFORMATION OBTAINING APPARATUS AND RADIO TIMEPIECE

CROSS-REFERENCE TO RELATED APPLICATION

The present application is based upon and claims the benefit of priority from the prior Japanese Patent Application No. 2008-178751, filed Jul. 9, 2008, the entire contents of which are incorporated herein by reference.

BACKGROUND OF THE INVENTION

1. Field of the Invention

The present invention relates to a time information obtaining apparatus, which receives a standard time radio wave to detect time information, and a radio timepiece provided with the time information obtaining apparatus.

2. Description of the Related Art

At the current time, the standard time radio waves are transmitted from radio stations in Japan, Germany, UK, Switzerland. In Japan, for example, amplitude modulated standard time radio waves are transmitted at 40 kHz and 60 kHz from radio stations in Fukushima and Saga Prefectures, respectively. The standard time radio wave that includes a time code bit string indicating date data (year, month, day, time) is transmitted every period of 60 seconds.

Timepieces (radio controlled timepieces) are in practical use, which receive the standard time radio wave including a time code bit string to detect the time code bit string, and correct a time counted within the timepiece based on the detected time code. The radio controlled timepiece is provided with a receiving circuit for receiving the standard time radio wave through an antenna, a band pass filter (BPF) for allowing only the standard time radio wave signal to pass through, a demodulating circuit for performing, for example, an envelope demodulating process to demodulate the standard time radio wave signal, and a processing circuit for detecting a time code included in the signal demodulated by the demodulating circuit.

The time code includes plural codes each appearing every unit time (1 second). The time code used in Japan includes a code "P", code "0" and a code "1", wherein the code "P" is a code of a duty 20%, which keeps a high level for first 0.2 seconds and then a low level for the remaining 0.8 seconds in the unit time, the code "0" is a code of a duty 50%, which keeps a high level for first 0.5 seconds and then a low level for the remaining 0.5 seconds in the unit time, and the code "1" is a code of a duty 80%, which keeps a high level for first 0.8 seconds and then a low level for the remaining 0.2 seconds in the unit time.

The code "P" is used as a marker indicating a beginning of one frame in frames of the time code and also used as a position marker indicating data sections including minute, hour, date, year data. The code "0" and code "1" indicate "0" and "1" in the binary system, respectively. The rising edge of each code corresponds to a "second" synchronizing point.

A conventional processing circuit synchronizes a demodulated signal at a rising edge, and binarizes the signal at a predetermined sampling period to obtain a binary bit string. The processing circuit measures a pulse width (a time length of a high level and a time length of a low level) of each code included in the obtained binary bit string, and determines depending on the measured pulse width, to which of the codes "P", "0" and "1" such measured code corresponds, and obtains the time information from a string of the determined codes.

The time code is carried by an amplitude modulated radio wave of 40 kHz and/or 60 kHz frequency. The amplitude modulated radio wave is easy to reduce and/or come under the influence of external noises while traveling in a space among buildings, whereby the time code would be damaged.

In a technique disclosed in Japanese Patent 2005-249632 A, a demodulated signal is binarized at a predetermined sampling period (50 ms), whereby TCO data is obtained. A list of data groups is produced, each consisting of a binary bit string including 20 sampled bits each appearing everyone second. The data groups are added every sampling point to obtain a stepwise waveform data, from which a "second" synchronizing point is detected.

In the technique disclosed in Japanese Patent 2005-249532 A, even though some noises are included in the demodulated signal, it is possible to detect the "second" synchronizing point. But when so many noises are included that a waveform of an original data pulse cannot be reproduced, it is hard to detect the "second" synchronizing point from the produced waveform data.

The present invention has been made to overcome the technical disadvantages involved in the conventional techniques, and has an object to provide a time information obtaining apparatus, which can detect the "second" synchronizing point with a high accuracy independently of noise effects and signal intensity of a received radio wave, and a radio timepiece provided with the time information obtaining apparatus

SUMMARY OF THE INVENTION

According to one aspect of the invention, there is provided a time information obtaining apparatus, which comprises a receiving unit for receiving a standard time radio wave to output a standard time signal that includes a time code consisting of plural codes, an input waveform data obtaining unit for sampling the standard time signal output from the receiving unit at a predetermined sampling period to obtain input waveform data having a unit time length, wherein the input waveform data at each sampling point is given by a value expressed in plural hits and the unit time length corresponds to a time length of each code included in the time code, an accumulating unit for accumulating the input waveform data obtained by the input waveform data obtaining unit, a position calculating unit for calculating a reference position on a time axis where one of a minimum value and maximum value of the input waveform data accumulated by the accumulating unit is given and a maximum gradient position on the time axis where a difference between values of the accumulated input waveform data at adjacent sampling points is maximum, and a controlling unit for calculating based on the reference position and the maximum gradient position calculated by the position calculating unit, a position on the time axis between the reference position and the maximum gradient position, which position corresponds to a leading position of a unit time length of the standard time signal including the time code.

According to other aspect of the invention, there is provided a radio timepiece, comprises a time information obtaining apparatus, wherein the time information obtaining apparatus comprises a receiving unit for receiving a standard time radio wave to output a standard time signal that includes a time code consisting of plural codes, en input waveform data obtaining unit for sampling the standard time signal output from the receiving unit at a predetermined sampling period to obtain input waveform data having a unit time length, wherein the input waveform data at each sampling point is given by a value expressed in plural bits and the unit time length corresponds to a time length of each code included in the time code, an accumulating unit for accumulating the input waveform data obtained by the input waveform data obtaining unit, a position calculating unit for calculating a reference position on a time axis where one of the minimum value and maximum value of the input waveform data accumulated by the accumulating unit is given and a maximum gradient position on the time axis where a difference between values of the accumulated input waveform data at adjacent sampling points is maximum, and a controlling unit for calculating based on the reference position and the maximum gradient position calculated by the position calculating unit, a leading position on the time axis of the unit time length of the standard time signal including the time code, between the reference position and the maximum gradient position; wherein the radio timepiece further comprises a decoding unit for obtaining a value of a code including date, time, minute data composing the time code, based on the leading position on the time axis of the unit time length of the standard time signal including the time code, calculated by the controlling unit, a current time calculating unit for calculating a current time based on the value of a code obtained by the decoding unit, an internal time counting unit for calculating a current time based on an internal clock, a time correcting unit for correcting the current time counted by the internal time counting unit, based on the current time calculated by the current time calculating unit, and a time displaying unit for displaying one of the current time counted by the internal time counting unit and the current time corrected by the time correcting unit.

DETAILED DESCRIPTION OF THE PREFERRED EMBODIMENTS

Now, embodiments of the present invention will be described with reference to the accompanying drawings In the embodiments of the present, a radio timepiece receives a standard time radio wave in a long-wave frequency band to detect a time code bit string indicating a time code, and adjusts the time based on the detected time code bit string.

At the current time, the standard time radio waves are transmitted from radio stations in Japan, Germany, UK, Switzerland. For example, in Japan, the amplitude modulated standard time radio waves are transmitted at 40 kHz and 60 kHz from radio stations in Fukushima and Saga Prefectures, respectively. The standard time radio wave includes a time code bit string indicating date data (year, month, date, hour and minute data) and is transmitted every period of 60 seconds.

Figure 1:
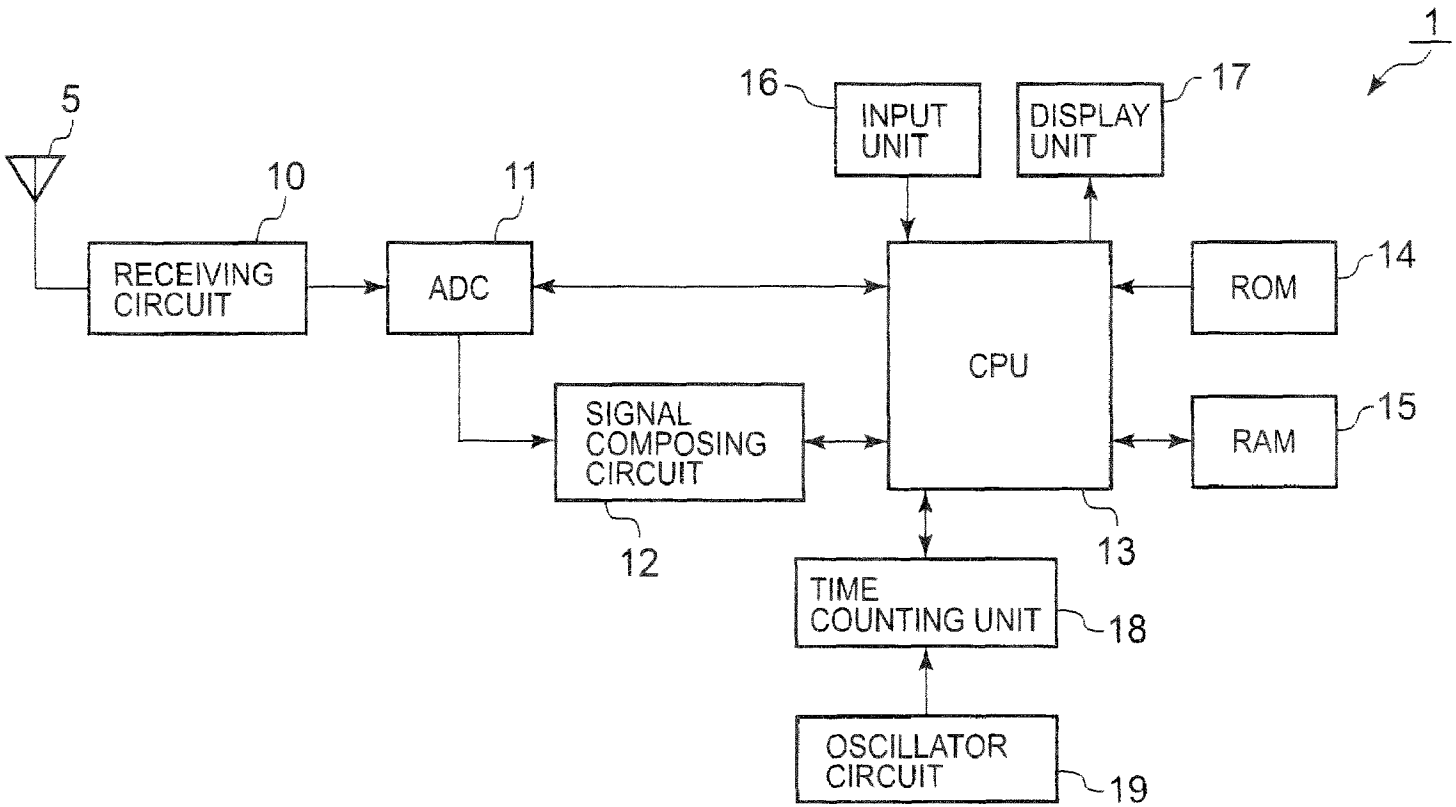
FIG. 1 is a block diagram showing a configuration of a radio timepiece according to the embodiments of the present invention.

FIG. 1 is a block diagram showing a configuration of the radio timepiece according to the embodiments of the invention. The radio timepiece 1 according to the embodiments of the invention comprises an antenna 5, receiving circuit 10, AD converter (ADC) 11, signal composing circuit 12, CPU 13, ROM 14, RAM 15, input unit 16, display unit 17, time counting circuit 18 and an oscillator circuit 19. As will be described in detail, the receiving circuit 10 comprises an amplifier circuit and detector circuit. The receiving circuit 10 receives the standard time radio wave through the antenna 5 and detects a standard time signal. The detected standard time signal is supplied to ADC 11. ADC 11 converts the supplied signal at a predetermined sampling frequency (for example, at 100 ms) into digital data.

The signal composing circuit 12 composes data having a unit time length to produce composed data for a purpose of a detecting a "second" synchronization timing. The signal composing circuit 12 may be made up of independent hardware from CPU 13 or may be set into CPU 13, which functions as the composing circuit.

CPU 13 reads a program from ROM 14 at a predetermined timing or in response to an operation signal input from the input unit 16 and expands the program on RAM 17. CPU 13 sends instructions and data to various parts in the radio timepiece based on the program expanded on RAM 17.

More specifically, for example, CPU 13 controls the receiving circuit 10 every certain period to receive the standard time radio wave and to obtain digital data from the received standard time radio wave. Then, CPU 13 performs a process for detecting a time code bit string included in the digital data to correct the current time counted by the time counting circuit 18 based on the detected time code bit string and a process for sending the corrected current time to display unit 17. The time counting circuit 18 calculates a clock signal generated by the oscillator circuit 19 to count the current time.

The input unit 16 comprises switches for performing various operations of the radio timepiece 1. The input unit 16 sends CPU 13 an appropriate operation signal, when a switch of the input unit 16 is operated. The display unit 17 comprises a dial plate, an analog indicating needle mechanism, and a liquid crystal display panel for displaying the current time counted by the time counting circuit 18. ROM 14 stores a system program for operating the radio timepiece 1 and realizing various functions and application programs. RAM 15 is used as a work area and temporarily stores the program and data read from ROM 14 and data processed by CPU 13.

Figure 2:
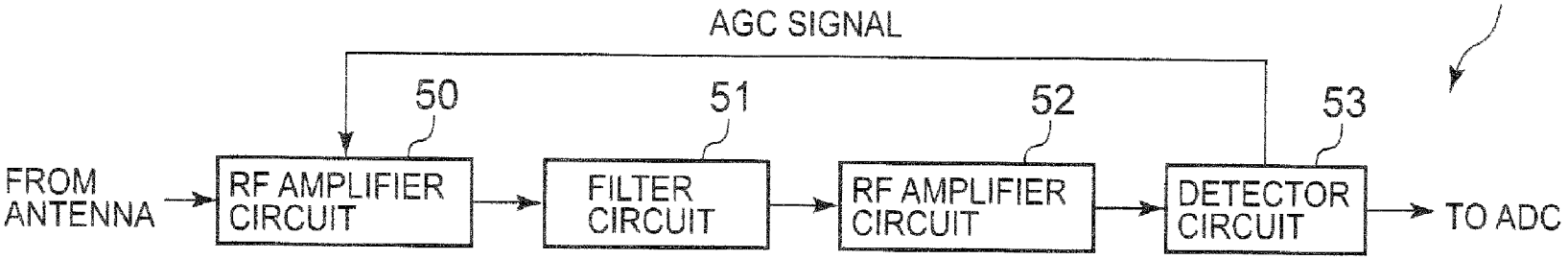
FIG. 2 is a view showing a circuit configuration of a receiving circuit in the radio timepiece.

FIG. 2 is a view showing a circuit configuration of the receiving circuit 10 of the radio timepiece. As shown in FIG. 2, the receiving circuit 10 comprises RF amplifier circuit 50, filter circuit 51, RF amplifier circuit 52, and a detector circuit 53. RF amplifier circuit 50 amplifies the signal supplied through the antenna 5. The filter circuit 51 serves to allow only a signal falling within a frequency band of the standard time radio wave to pass through. The RF amplifier circuit 52 amplifies the signal passing through the filter circuit 51. The detector circuit 53 detects a signal including a time code from the signal output from the amplifying circuit 52. The output signal of the detector circuit 53 is a demodulated signal including the time code. The demodulated signal is fed back from the detector circuit 53 to RF amplifier circuit 50 as a gain control signal (AGC signal), thereby controlling a gain of RF amplifier circuit 50.

Figure 3A:
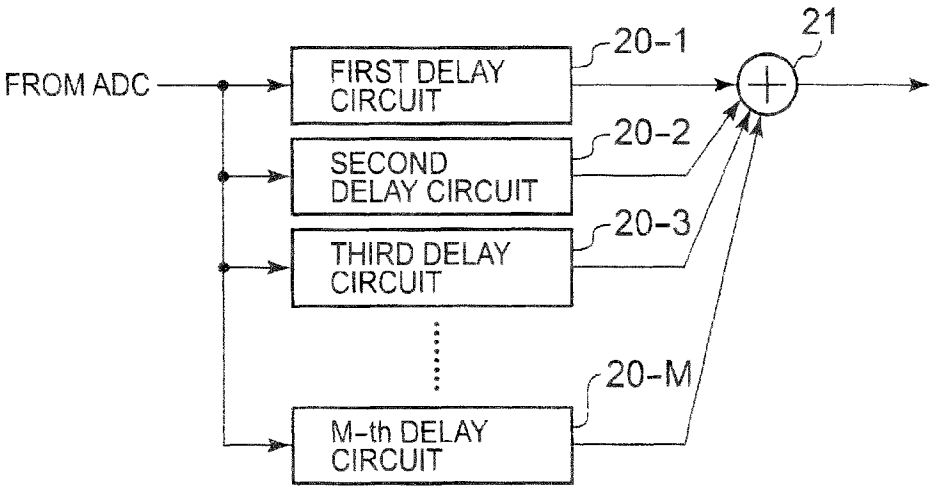
FIG. 3*a* is a view showing an example of a circuit configuration of a signal composing circuit in the radio timepiece.

FIG. 3*a* is a view showing an example of a circuit configuration of the signal composing circuit 12. The signal composing circuit 12 comprises "M" units of delay circuits 20-1 to 20-M and an adding circuit 21. The delay circuits 20-1 to 20-N successively receive from ADC 11 input waveform data having a unit time length, and delay the received data by a predetermined time. In the present embodiment, the input waveform data includes 10 pieces of data (sampled data) sampled at a sampling period of 100 ms, wherein the sampled data is expressed in plural bits at each sampling point. In the present embodiment, the sampling period is equivalent to 1 second, which means that the standard time radio wave signal employs a data format including 60 pieces of bits each having 1 second time length.

In the signal composing circuit 12 shown in FIG. 3*a,* the first delay circuit 20-1 receives and holds the first input waveform data having a unit time length in the first unit time period. In the second unit time period after 1 second from the first unit time period, the second delay circuit 20-2 receives and holds the second input waveform data having a unit time length. In this way, finally in the M-th unit time period after "M-1" seconds from the first unit time period, the M-th delay circuit 20-M receives and holds the M-th input waveform data having a unit time length.

Figure 4:
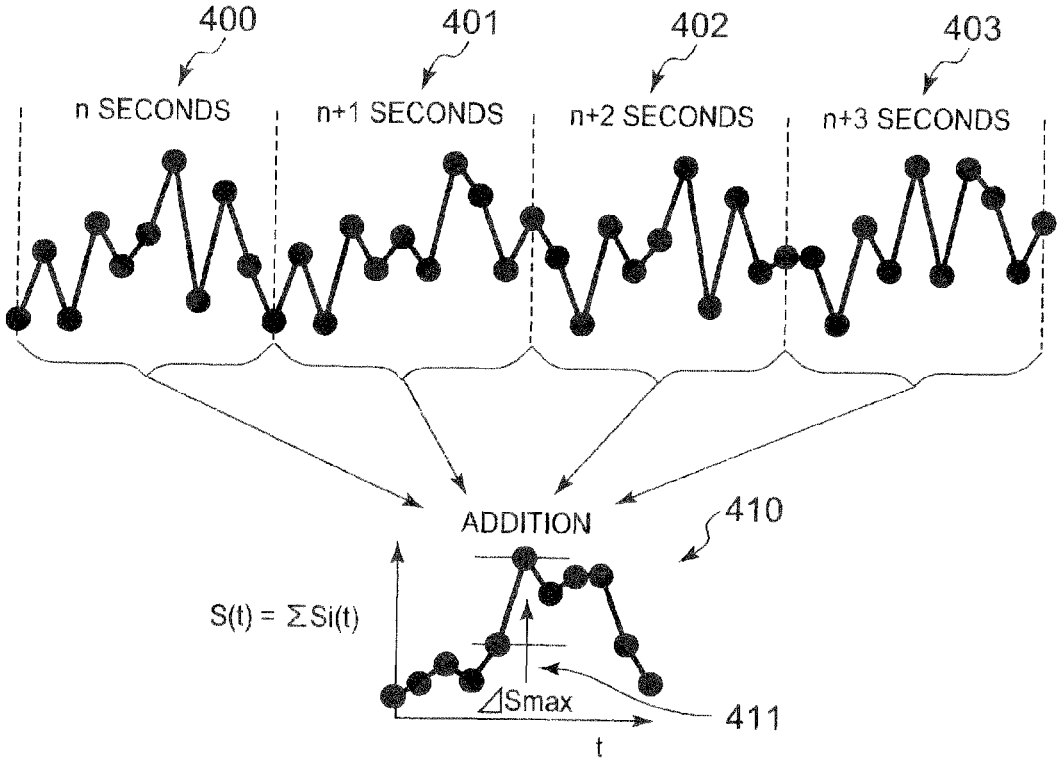
FIG. 4 is a view for explaining an adding process performed in the signal composing circuit in the present embodiment, wherein bit values at corresponding sampling points are added.

While the first to M-th input waveform data each having a unit time length are held in the first to M-th delay circuits 20-1 to 20-M, respectively, the adding circuit 21 adds bit values of the first to M-th input waveform data at the corresponding sampling points. FIG. 4 is a view for explaining an adding process performed in the signal composing circuit 12, wherein the bit values of the input waveform data at appropriate sampling points are added together. In FIG. 4 is shown the input waveform data Si (t) (i=1-4 and t=1-10) in 4 periods from the unit time period (the first unit time period) corresponding to "n" seconds to the unit time period ($4^{th}$ unit time period) corresponding to "n+3" seconds (Refer to reference numerals 400-403). Bit values of M pieces of input waveform data (M=4 in FIG. 4) at the corresponding sampling points are added by the adding circuit 21, and accumulated waveform data, S(t) (=ΣSi(t)) is obtained (Refer to a reference numeral 410).

Figure 3B:
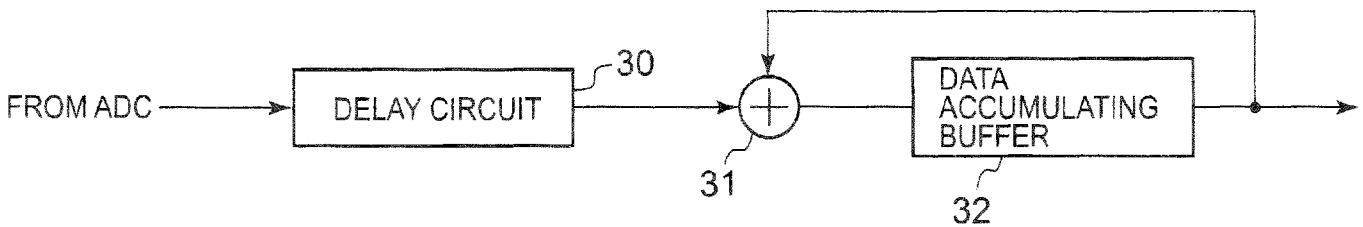
FIG. 3*b* is a view showing another example of the circuit configuration of the signal composing circuit in the radio timepiece.

In practice, the signal composing circuit 12 may be set up without using the "M" units of delay circuits. FIG. 3*b* is a view showing another circuit configuration of the signal composing circuit 12. As shown in FIG. 3*b*, the signal composing circuit 12 comprises a delay circuit 30, an adding circuit 31, and a data accumulating buffer 32. The delay circuit 30 temporarily holds input waveform data and outputs a bit value at a delayed sampling point. The data accumulating buffer 32 holds waveform data accumulated and output from the adding circuit 31 and outputs bit values at respective sampling points. The bit value at the delayed sampling point and the bit value of the accumulated waveform data at such delayed sampling point are added together by the adding circuit 31, and the sum is stored in the data accumulating buffer 32. The above process is repeatedly performed to accumulate bit values at the corresponding sampling point a desired number of times, whereby accumulated waveform data can be obtained.

Figure 11:
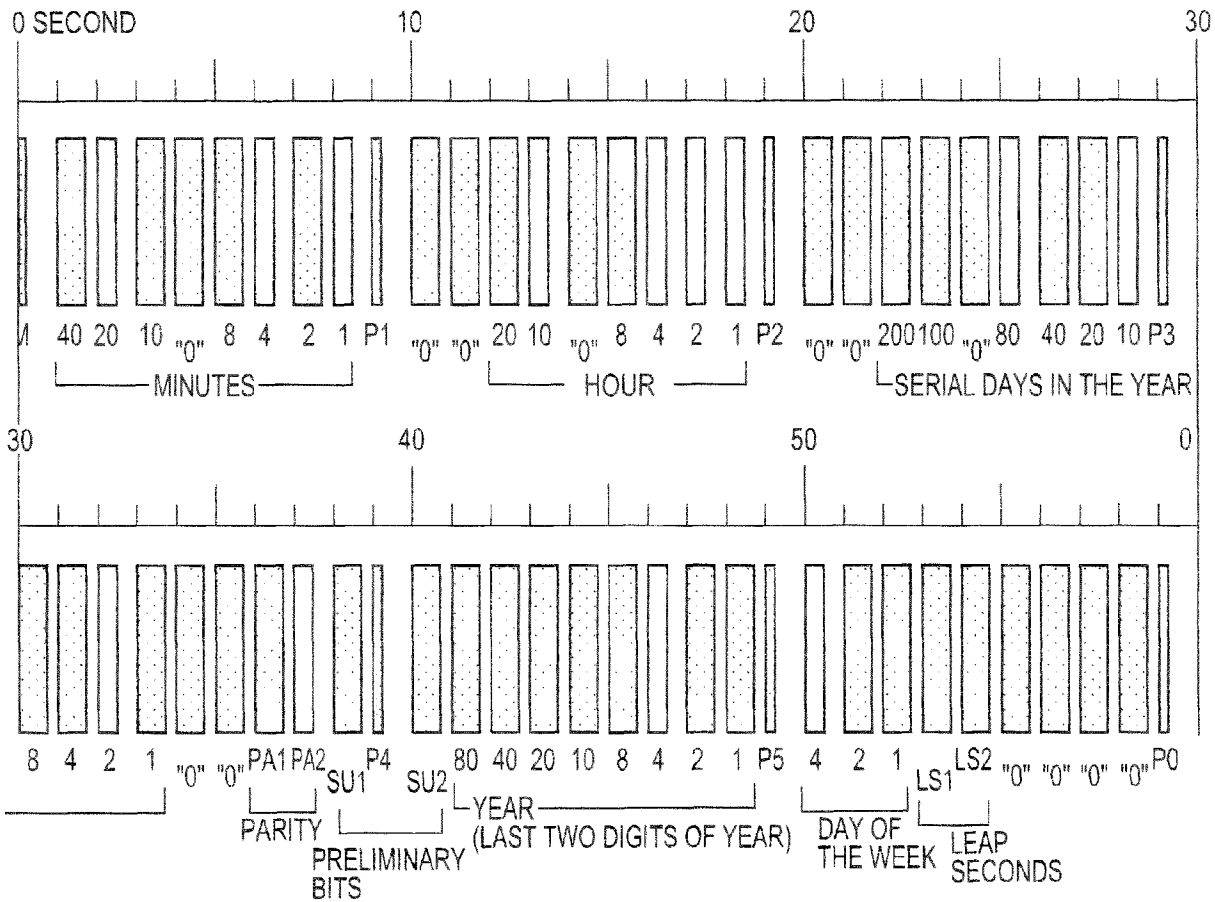
FIG. 11 is a view showing an example of the standard time radio wave signal in Japan

FIG. 11 is a view showing an example of the standard time radio wave signal employed in Japan. The standard time radio wave signal is transmitted in a predetermined format shown in FIG. 11. The standard time radio wave signal comprises a string of codes each having a unit time length of "1" second and each indicating one of "P", "1" and "0". The code of "P" is a 20% duty code (having a high level in the first 20% period and a low level in the remaining 80% period). The code of "1" is a 50% duty code and the code of "0" is an 80% duty code. In the standard time signal shown in FIG. 11, a position of code rising from a low level to a high level corresponds to a leading position of "second" ("second" synchronizing position). Therefore, the rising position of code is detected in a "second" synchronizing process in the present embodiment.

Figure 5:
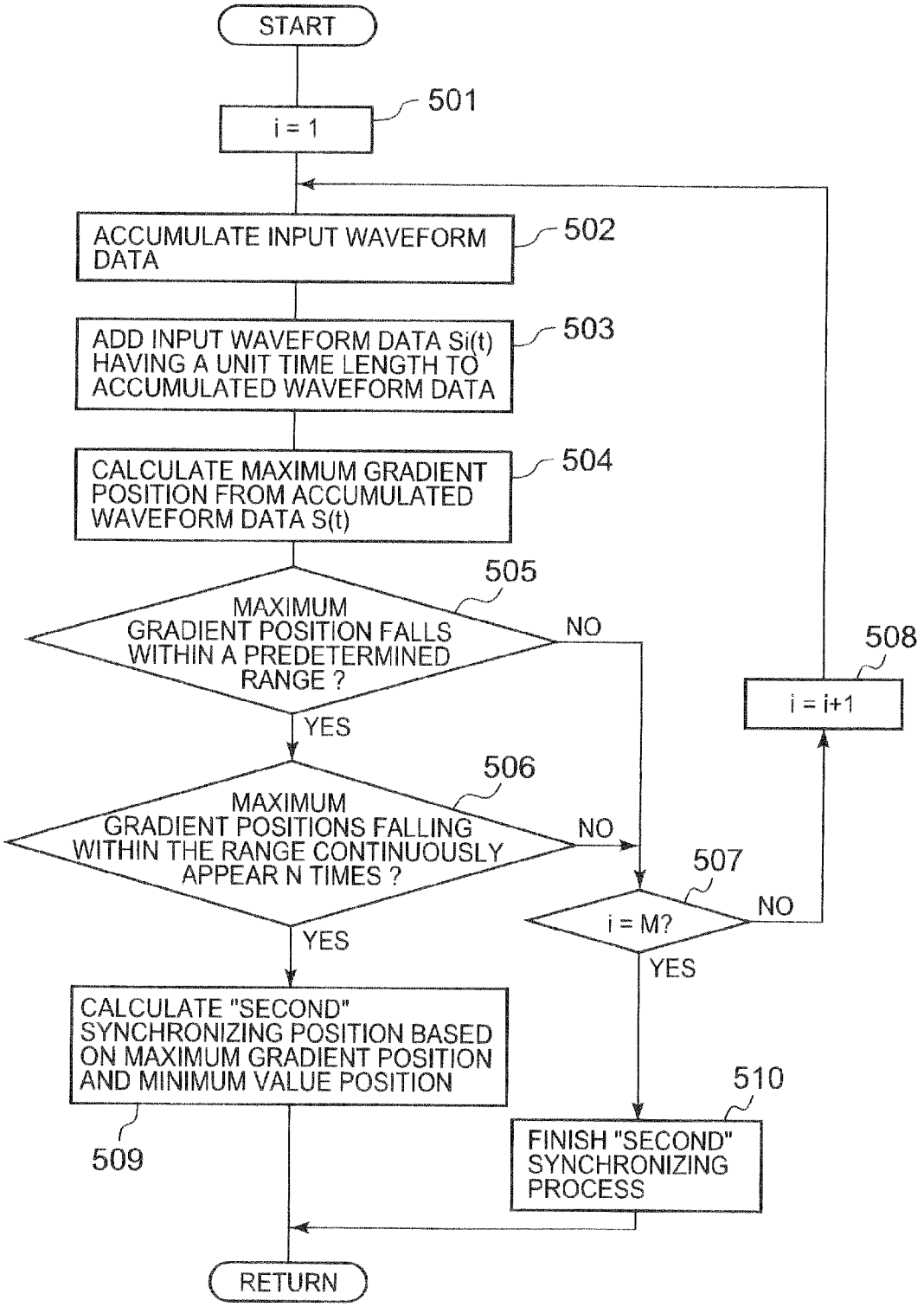
FIG. 5 is a flow chart of a "second" synchronizing process to be performed by CPU 13 and the signal corresponding circuit 12 in the present embodiment.
Figure 6:
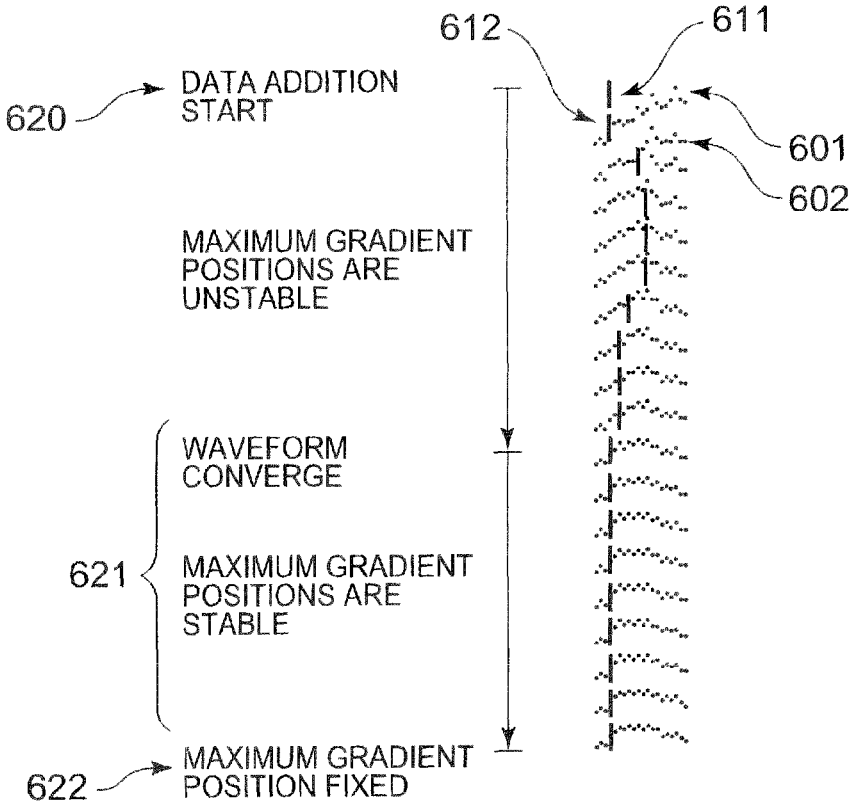
FIG. 6 is a view schematically illustrating accumulated waveform data in the "second" synchronizing process in the present embodiment.

FIG. 5 is a flow chart of the "second" synchronizing process to be performed by CPU 13 and the signal composing circuit 12 in the present embodiment. FIG. 6 is a view schematically illustrating accumulated waveform data in the "second" synchronizing process in the present embodiment. For performing the "second" synchronizing process of FIG. 5, the signal composing circuit 12 employs the circuit configuration shown in FIG. 3*b*, but may employ a circuit configuration other than that of FIG. 3*b*. CPU 13 initializes a parameter "i" to "1" at step 501, wherein the parameter "i" indicates the number of accumulated waveform data. The delay circuit 30 of the signal composing circuit 12 accumulates input waveform data Si(t) having a unit time length at step 502. The adding circuit 31 adds a data value of the input waveform data having a unit time length at a sampling point to a data value of accumulated waveform data at the corresponding sampling point, supplied from the data accumulating buffer 32 at step 503, whereby new accumulated waveform data S(t) is obtained. The obtained accumulated waveform data S(t) is stored in the data accumulating buffer 32.

Then, CPU 13 refers to the accumulated waveform data stored in the data accumulating buffer 32 at step 504 to calculate a maximum gradient position where a difference between data values at adjacent sampling points is maximum. In FIG. 4, a position indicated by an arrow 411 is the maximum gradient position where the maximum gradient value ΔSmax is given. In the present embodiment, plural sampling points where the maximum gradient values are given, whichever larger on the time axis is employed.

Figure 10:
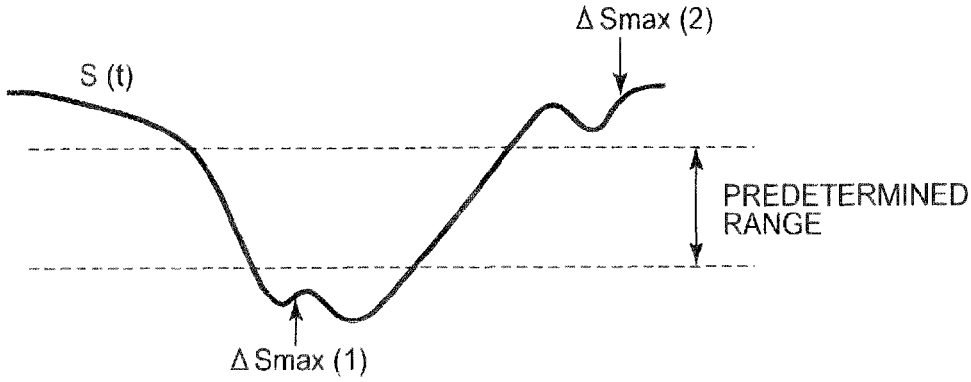
FIG. 10 is a view for explaining a process at step 505 in the "second" synchronizing process in the present embodiment.

CPU 13 judges at step 505 whether or not the maximum gradient value ΔSmax falls within a predetermined range. As shown in FIG. 10, CPU 13 judges at step 505 whether the maximum gradient value ΔSmax falls within the predetermined range, thereby excluding a position where the maximum gradient value ΔSmax (1) is given, which is lower than the predetermined range and a position where the maximum gradient value ΔSmax (2) is given, which is larger than the predetermined range. As described, since the position where the extremely low maximum gradient value is given and the position where the extremely large maximum gradient value is given are excluded, the accuracy or detecting the synchronization position of "second" can be improved.

When it is determined at step 505 that the maximum gradient value ΔSmax falls within the predetermined range (YES at step 505), CPU 13 judges at step 506 whether or not the maximum gradient positions falling within the predetermined range appear "N" successive times (N<M). In FIG. 6, a group of accumulated waveform data is shown by thin broken lines (Refer to reference numerals 601 and 602). Vertical bold lines among the accumulated waveform data indicate the maximum gradient positions (Refer to reference numerals 611 and 621). If the maximum gradient position corresponds substantially to the rising position of the waveform data, the maximum gradient position would converge substantially to one position in accumulated input waveform data independently of noise effects. In other words, the maximum gradient positions are unstable for some time after the beginning of data addition (Refer to a reference numeral 620), but when the waveform of accumulated waveform data begins to converge, the maximum gradient positions converge and keep substantially a constant position (Refer to a reference numeral 621). Therefore, in the present embodiment, when the maximum gradient positions keep substantially a constant position more than "N" times, in other words, the maximum gradient positions fall within the predetermined range, it is determined that the maximum gradient positions have converged (Refer to a reference numeral 622).

If a difference is less than a predetermined value, between the maximum gradient position calculated in the last process and the maximum gradient position calculated in the present process, then it is determined at step 506 that the maximum gradient positions fall within the predetermined range.

When it is determined at step 505 that the maximum gradient value does not fall within the predetermined range NO at step 505) or it is determined at step 506 that the maximum gradient positions falling within the predetermined range do not appear "N" successive times (NO at step 506), CPU 13 judges at step 507 whether or not the parameter "i" has reached "M", in other words, whether or not the process has been performed "M" times. When it is determined at step 507 that the parameter "i" has not reached "M" (NO at step 507), CPU 13 increments the parameter "i" at step 508, and returns to step 502. When it is determined at step 507 that the parameter "i" has reached "M" (YES at step 507), CPU 13 finishes the "second" synchronizing process at step 510, or CPU 13 can returns to step 501 to resume the "second" synchronizing process.

Figure 7:
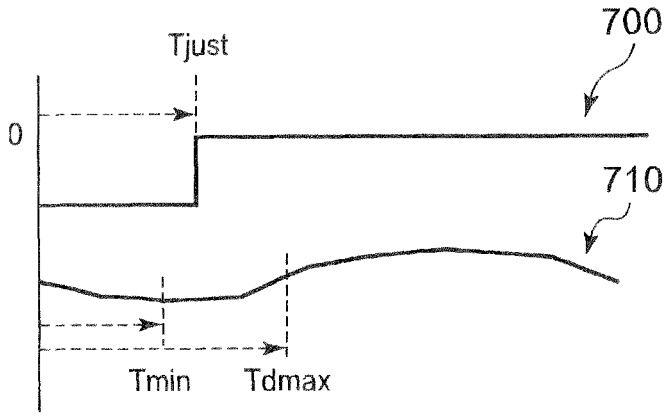
FIG. 7 is a view for explaining calculation of the "second" synchronizing position in the present embodiment.

When it is determined at step 506 that the maximum gradient positions falling within the predetermined range appear "N" successive times (YES at step 506), CPU 13 calculates a "second" synchronizing position based on the maximum gradient position and a minimum gradient position where the minimum value of the accumulated waveform data is given at step 509. FIG. 7 is a view for explaining calculation of the "second" synchronizing position in the present embodiment. In FIG. 7, a radical waveform is indicated by a reference numeral 100. Therefore, in calculation of the "second" synchronizing position, it is preferable that a rising time Tjust of the radical waveform 700 is obtained as the "second" synchronizing position. But an actually obtained waveform (waveform of the accumulated waveform data) 710 includes a transitional waveform as shown in FIG. 7. In FIG. 7, Tdmax denotes the maximum gradient position of the waveform 710 and Tmin denotes the minimum gradient position of the waveform 10. As will be described later, a rising position of the waveform is detected, and the minimum gradient position Tmin is used as a reference position Tref in the present embodiment.

As shown in FIG. 7, the radical "second" synchronizing position Tjust of the waveform 700 appears between the maximum gradient position Tdmax and the minimum gradient position Tmin of the waveform 710. Therefore, in the present embodiment, the "second" synchronizing position is estimated based on the maximum gradient position Tdmax and the minimum gradient position Tmin of the waveform 710. For instance, the "second" synchronizing position can be calculated using the following mathematical formulas (1) to (4). The estimated "second" synchronizing position calculated using the formulas is expressed by Tsync.

$$Tsync = Tmin + C \text{ (C is a constant)} \quad (1)$$

$$Tsync = Td\max - C \text{ (C is a constant)} \quad (2)$$

$$Tsync = (Tmin + Td\max)/2 \quad (3)$$

$$Tsync = (Tmin + 3Td\max)/4 \quad (4)$$

CPU 13 selects one of the above four formulas (1) to (4), depending on signal intensity of the standard time radio wave received by the receiving circuit 10 or in response to an user's operation on the input unit 16.

Figure 8A:
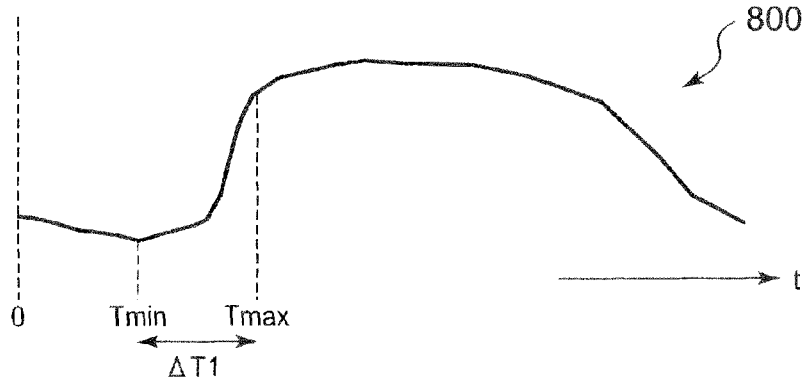
FIGS. 8*a* and 8*b* are views for explaining calculation of the "second" synchronizing position in the present embodiment.
Figure 8B:
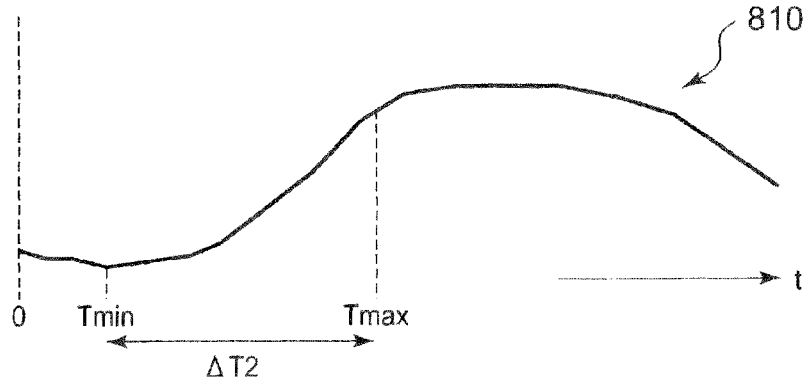

The inventor of the present invention is aware that, as the signal intensity of the standard time radio wave decreases, the maximum gradient position Tdmax would be reached more late from the minimum gradient position Tmin in the waveform 710. As shown in FIG. 8*a*, in the case the standard time radio wave of high signal intensity is received, a waveform 800 would rise in a comparatively rapid manner, and Tdmax would appear immediately after Tmin (Tdmax appears late after Tmin by ΔT1). Meanwhile, as shown in FIG. 8*b*, in the case the standard time radio wave of low signal intensity is received, a waveform 810 would rise in a comparatively gentle manner, and Tdmax would appear long after Tmin (Tdmax appears late after Tmin by ΔT2, where ΔT2>ΔT1). In the present embodiment, CPU 13 can calculate the "second" synchronizing position Tsync, using the following mathematical formula (5). In the calculation using this mathematical formula (5), signal intensity of the standard time radio wave received by the receiving circuit 10 is detected, and a parameter "n" (0<n<1) is used, which increases as the signal intensity decreases.

$$Ysync = nTmin + (1-n)Td\max \quad (5)$$

Figure 9:
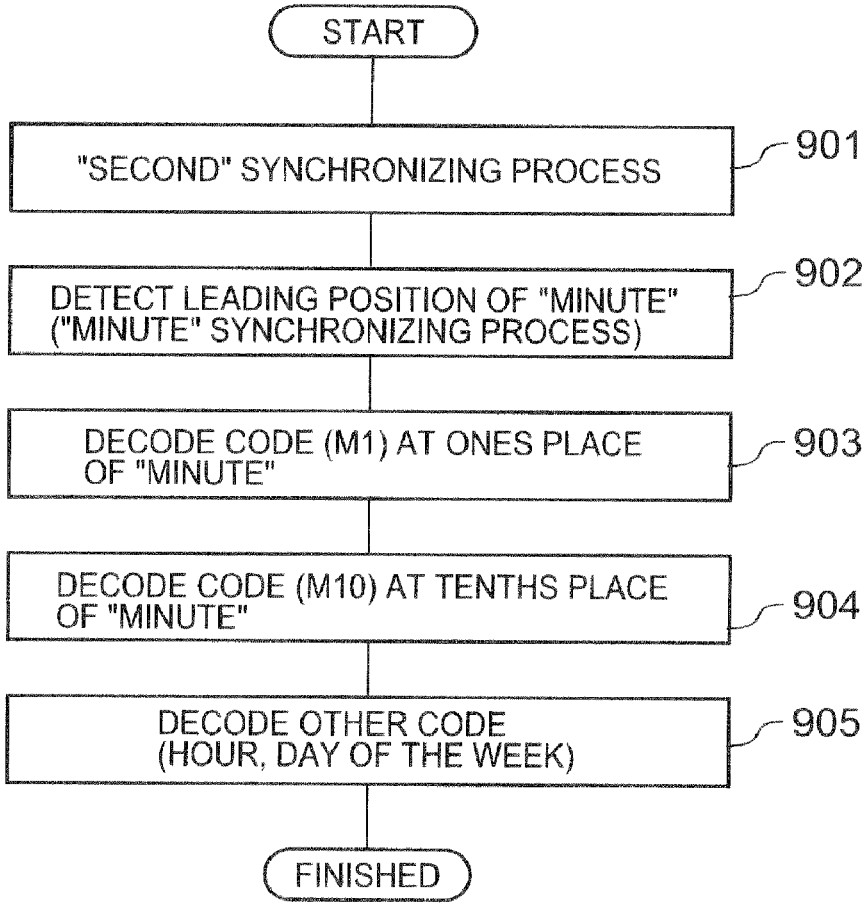
FIG. 9 is a flow chart of a process performed in the radio timepiece according to the present embodiment.

When the "second" synchronizing position is calculated, then other necessary process is performed, including a process for detecting a leading position of "minute". FIG. 9 is a flow chart of a process performed in the radio timepiece according to the present embodiment. In the flow chart of FIG. 9, the "second" synchronizing process is performed at step 901, as described with reference to the flow chart of FIG. 5. After the "second" synchronizing process has been performed at step 901, CPU 13 performs a process ("minute" synchronizing process) for detecting a leading position of "minute", using data output from ADC 11 at step 902. As shown in FIG. 11, in one minute (one frame) of the standard time radio wave signal, the code of "P" appears continuously at a position corresponding to 59 seconds and a position corresponding to 00 second. Therefore, CPU 13 refers to the data output from AUC11 to detect a position where the code of "P" appears continuously.

CPU 13 decodes various codes such as a code (M1) at ones place of "minute", a code (M10) at tenths place of "minute", and other code indicating hour, date and day of the week, included in the standard time radio wave signal. When the "minute" leading position is detected and fixed at step 902, positions of all the codes such as a code at ones place of "minute" (for instance, a position corresponding to 5-8 seconds from the leading position), and a code at tenths place of "minute" (a position corresponding to 1-3 seconds from the leading position) are fixed. Therefore, in processes at steps 903 to 905, CPU 13 obtains a predetermined number of data at positions of all the codes to be decoded as input waveform data and determines which code each piece of input waveform data expresses "0" or "1" to fix a code value of the code.

CPU 13 calculates the correct current time based on the fixed code values of the codes. CPU 13 corrects the current time internally calculated by the time counting circuit 18 based on the calculated correct current time. The corrected current time is displayed on the display unit 17.

In the present embodiment, a predetermined number of input waveform data having a unit time length are accumulated, whereby accumulated input waveform data is obtained. A minimum value position on the time axis is acquired, where the minimum value of the accumulated input waveform data is obtained. Meanwhile, a maximum gradient position on the time axis is calculated, where a maximum difference between values of the accumulated input waveform data at adjacent sampling points is obtained. Then, based on these calculated minimum value position and maximum gradient position, the leading position ("second" synchronizing position) is specified between the minimum value position and maximum gradient position, which leading position corresponds to the beginning point of the unit time of the signal including the time code. The leading position is specified between the minimum value position and maximum gradient position in the accumulated input waveform data, whereby more accurate leading position of "second" ("second" synchronizing position) can be acquired.

As described above, the time information obtaining apparatus and the radio timepiece using such time information obtaining apparatus are provided, which are able to detect the "second" synchronizing position with a high accuracy independently of signal intensity and noise effects.

In the embodiment, as the signal intensity of the standard time radio wave decreases lower, the leading position of "second" is specified at a position nearer the maximum gradient position on the time axis between the minimum value position and maximum gradient position in the accumulated input waveform data. Therefore, even though the input waveform alters due to alteration in signal intensity, a more proper leading position of "second" ("second" synchronizing position) can be acquired.

More specifically, using the parameter "n" ($0<n<1$), which increase as the signal intensity decreases, the leading position of "second" ("second" synchronizing position) Tsync can be aquired by operating the following mathematical formula:

$$Tsync=nTmin+(1-n)Tdmax$$

where Tmin denotes the minimum value position and Tdmax denotes the maximum gradient position. As described, a proper leading position of "second" ("second" synchronizing position) can be acquired by a simple mathematical operation.

In the present embodiment, the leading position of "second" Tsync can be acquired by operating one formula selected among the following mathematical formulas:

$$Tsync=Tmin+C(C \text{ is a constant})$$

$$Tsync=Tdmax-C(C \text{ is a constant})$$

$$Tsync=(Tmin+Tdmax)/2$$

$$Tsync=(Tmin+3Tdmax)/4$$

where Tmin denotes the minimum value position and Tdmax denotes the maximum gradient position.

As described above, a desired and proper leading position of "second" can be acquired by operating the mathematical formula that is selected depending on the signal intensity of the received standard time radio wave or the user's setting condition.

Further in the present embodiment, in the case plural pieces of input waveform data are successively accumulated and the successively calculated maximum gradient positions converge into a predetermined range, the leading position of "second" ("second" synchronizing position) is calculated based on the converged leading position of "second". Using the maximum gradient position that is employed when the input waveform data is brought into a steady state, a more accurate leading position of "second" can be calculated.

In the present embodiment, in the case the maximum gradient value where a difference between values at adjacent sampling points is maximum falls within a predetermined range, it is determined that the maximum gradient position corresponding to the maximum gradient value is the leading position of "second". An extremely low maximum gradient value and an extremely large maximum gradient value are excluded, whereby the leading position of "second" can be detected with a high accuracy.

The present invention is by no means restricted to the embodiments described above, and as a matter of course, various alterations and/or modifications may be made and fall within the scope of the invention defined in claims attached hereto.

In the present embodiment, the waveform rises from a low level to a high level at the leading position of "second" ("second" synchronizing position). Therefore, when a difference between values at adjacent sampling points is maximum in the "second" synchronizing process (FIG. 5), an increasing rate of the value will be maximum at the sampling point. On the contrary, in the case the waveform comes down from a high level to a low level at the leading position of "second" ("second" synchronizing position), when a difference between values at adjacent sampling points is maximum, a decreasing rate of the value will be maximum at the sampling point. This instance is included in the scope of the invention. In the case a "second" synchronizing position is set at a position on the time axis where a value of the accumulated waveform data comes down from a high level to a low level, a maximum value position at which the maximum value of the accumulated waveform data is given is used as a reference position "Tref". Then, the leading position of "second" is calculated based on the maximum value position and the maximum gradient position. Therefore, the invention can be used for the time code that has the leading position of "second" at the position where a value of the accumulated waveform data comes down from a high level to a low level.

In the present embodiment, positions on the time axis where a difference between values of the accumulated waveform data at adjacent sampling points are maximum, whichever is larger on the time axis is employed as the maximum gradient position, but the above positions whichever is less on the time axis may be employed as the maximum gradient position. When a difference between values of the accumulated waveform data at adjacent sampling points are maximum, a middle position of the two adjacent sampling positions may be used in place of the maximum gradient position.

What is claimed is:

1. A time information obtaining apparatus comprising:

a receiving unit for receiving a standard time radio wave;

an input waveform data obtaining unit for sampling a signal that includes a time code output from the receiving unit at a predetermined sampling period to obtain input waveform data having a unit time length, wherein the input waveform data at each sampling point is given by a value expressed in plural bits and the unit time length is a time corresponding to one code composing the time code;

an accumulating unit for accumulating the input waveform data;

a position calculating unit for calculating a reference position, which is a position on a time axis which shows a minimum value or a maximum value of the input waveform data accumulated by the accumulating unit, and a maximum gradient position, which is a position on the time axis where a difference between values of the accumulated input waveform data at adjacent sampling points is maximum; and a controlling unit for calculating, based on the reference position and the maximum gradient position, a leading position of a unit time of the signal including the time code, between the reference position and the maximum gradient position.

2. The time information obtaining apparatus according to claim 1, wherein the controlling unit obtains a signal intensity of the standard time radio wave received by the receiving unit and calculates the leading position such that the leading position is nearer the maximum gradient position between the reference position and the maximum gradient position as the detected signal intensity decreases.

3. The time information obtaining apparatus according to claim 2, wherein the controlling unit calculates the leading position Tsync using the formula:

$$Tsync = nTref + (1-n)Td\max,$$

where Tref is the reference position, Tdmax is the maximum gradient position, and n is a parameter ($0<n<1$) that increases as the signal intensity decreases.

4. The time information obtaining apparatus according to claim 1, wherein the controlling unit calculates the leading position Tsync using one of the following mathematical formulas:

$$Tsync = Tref + C \text{(where C is a constant)}$$

$$Tsync = Td\max - C \text{(where C is a constant)}$$

$$Tsync = (Tref + Td\max)/2$$

$$Tsync = (Tref + 3Td\max)/4$$

where Tref is the reference position and Tdmax is the maximum gradient position.

5. The time information obtaining apparatus according to claim 1, wherein, when maximum gradient positions successively calculated based on the accumulated input waveform data have converged into a predetermined range, the controlling unit calculates the leading position based on the converged maximum gradient position.

6. The time information obtaining apparatus according to claim 1, wherein, when a maximum gradient value, which is a value given when the difference between values of the accumulated input waveform data at adjacent sampling points is maximum, remains within a predetermined range, the controlling unit uses as the leading position, the maximum gradient position of the maximum gradient value.

7. A radio timepiece comprising:

the time information obtaining apparatus according to claim 1;

a decoding unit for obtaining values of codes including date, time, and minute data composing the time code, based on the leading position of the unit time of the signal including the time code calculated by the time information obtaining apparatus;

a current time calculating unit for calculating a current time based on the values of the codes obtained by the decoding unit;

an internal time counting unit for calculating a current time using an internal clock;

a time correcting unit for correcting the current time counted by the internal time counting unit, based on the current time calculated by the current time calculating unit; and a time displaying unit for displaying the current time counted by the internal time counting unit or the current time corrected by the time correcting unit.

* * * * *